US006847042B2

(12) United States Patent
Maolinbay et al.

(10) Patent No.: US 6,847,042 B2
(45) Date of Patent: Jan. 25, 2005

(54) CENTROID APPARATUS AND METHOD FOR SUB-PIXEL X-RAY IMAGE RESOLUTION

(75) Inventors: Manat Maolinbay, Sunnyvale, CA (US); Paul R. Granfors, Sunnyvale, CA (US)

(73) Assignee: GE Medical Systems Global Technology Co., LLC, Waukehsa, WI (US)

( * ) Notice: Subject to any disclaimer, the term of this patent is extended or adjusted under 35 U.S.C. 154(b) by 0 days.

(21) Appl. No.: 10/465,270

(22) Filed: Jun. 19, 2003

(65) Prior Publication Data

US 2004/0258206 A1 Dec. 23, 2004

(51) Int. Cl.[7] ..... H01J 47/00
(52) U.S. Cl. ..... 250/385.1; 378/98.8
(58) Field of Search ..... 378/98.8; 250/207, 250/214 R, 214.1, 374, 385.1

(56) References Cited

U.S. PATENT DOCUMENTS 5,192,861 A * 3/1993 Breskin et al. ..... 250/214 VT
6,011,265 A 1/2000 Sauli
6,316,773 B1 * 11/2001 Giakos ..... 250/394
2001/0032934 A1 * 10/2001 Lee et al. ..... 250/370.09

* cited by examiner

*Primary Examiner*—Craig E. Church
*Assistant Examiner*—Jurie Yun
(74) *Attorney, Agent, or Firm*—Quarles & Brady LLP; Carl Horton

(57) ABSTRACT

An apparatus for detecting X-rays comprises a scintillator which emits a plurality of photoelectrons upon being impacted by an X-ray photon. The photoelectrons are amplified in a gas electron multiplier and the resultant photoelectrons are accumulated on a two dimensional array of charge collection electrodes. Electrical signals are produced which indicate the quantity of photoelectrons which strike each charge collection electrode. A processor determines a location of the X-ray photon strike by analyzing the spatial distribution of the photoelectrons accumulated by the array of charge collection electrodes. The intensity of the X-ray photon is determined from the number of accumulated photoelectrons.

17 Claims, 2 Drawing Sheets

CENTROID APPARATUS AND METHOD FOR SUB-PIXEL X-RAY IMAGE RESOLUTION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

1. Field of the Invention

The present invention relates to X-ray imaging apparatus; and more particularly to X-ray detectors which produce electrical image signal in such apparatus.

2. Description of the Related Art

Conventional X-ray imaging equipment includes a source for projecting a beam of X-rays through an object being imaged, such as a medical patient. The portion of the beam which passes through the patient impinges upon an X-ray detector which converts the X-rays attenuated by the patient into photons which then are converted into an electric image signal. One type of X-ray detector has a combination of a scintillator in front of a two dimensional array of photodetectors. Each photodetector integrates the energy of the impacting X-ray photons over the period of X-ray exposure time to produce a signal that is proportional to the X-ray energy integral or X-ray intensity. The electrical signal from each photodetector forms a picture element, commonly referred to as a pixel, which are processed and combined to form an image that is displayed on a video monitor. The resolution of the resultant X-ray image was adversely affected by the diversion, or spreading, of the light within the scintillator. In order to increase X-ray detection efficiency, it is desirable to increase the thickness of the scintillator, however increased thickness also increases the light spread.

U.S. Pat. No. 6,011,265 discloses a detector which can be used for X-rays or gamma rays. The radiation enters the detector through an inlet window and interacts with a gas to generate primary electrons. Those electrons pass through a cascaded series of gas electron multipliers (GEMs). Ultimately striking a linear set of charge collection electrodes. The charge collection electrodes are connected to read-out electronics which produce a pixel from the signal from each electrode.

The resolution of the resultant X-ray data is limited by the pitch, or spacing, of the charge collection electrodes. Thus, the ability to physically construct the electrode array and read-out electronics connected thereto, limits the resolution of the X-ray detector. Although advances in microelectronics enable formation of finer electrodes and denser electronic read-out circuitry to increase the image resolution, such increased resolution comes with a significant cost increase. Therefore, it is desirable to increase the X-ray image resolution without paying the price of increased density of the charge collection electrodes and electronics.

SUMMARY OF THE INVENTION

The present invention relates to forming an X-ray image by sensing each impact of an X-ray photon, known as a photon event, on a detection apparatus, The location of the photon event is determined and the number of photon events at each defined location on the apparatus are counted for use in constructing the X-ray image.

That apparatus for detecting the X-rays comprises a scintillator which emits a plurality of photoelectrons upon being impacted by an X-ray photon. That impact is referred to as an X-ray photon event. A gas electron multiplier, with a plurality of stages, is adjacent the scintillator to receive the photoelectrons. A two dimensional array of charge collection electrodes is positioned to receive photoelectrons emitted by the gas electron multiplier in response to receipt of the plurality of photoelectrons from the scintillator. Each charge collection electrode produces an electrical signal indicating the quantity of photoelectrons which have struck that respective charge collection electrode.

The electrical signals from the array of charge collection electrodes are fed to a signal processor. The signal processor analyzes the electrical signals and defines a two dimensional matrix of the charge collection electrodes in the two dimensional array. Preferably a square matrix is defined that is centered about the charge collection electrode that produced the electrical signal indicating the greatest number of photoelectron strikes. The analysis of the electrical signals from the charge collection electrodes in the matrix determines a location of the X-ray photon event. Therefore, the adverse effect on image resolution that results from light spread in the scintillator is reduced by locating the X-ray photon event with more precision according to the present technique. This allows a thicker scintillator to be employed for increased X-ray detection efficiency without a significant decrease in image resolution.

In the preferred embodiment of the present apparatus, the signal processor determines the location of the X-ray photon event by deriving intensity weighted means of the electrical signals in two orthogonal dimensions in the matrix of charge collection electrodes. For example, the orthogonal coordinates x, y for the X-ray photon event location of the X-ray photon event can be derived according to the equations:

$$x = \frac{\sum_{i}^{m} n_i x_i}{\sum_{i}^{m} n_i} = \frac{\sum_{i}^{m} n_i x_i}{N_m}$$

$$y = \frac{\sum_{i}^{m} n_i y_i}{\sum_{i}^{m} n_i} = \frac{\sum_{i}^{m} n_i y_i}{N_m}$$

where x is a coordinate of the pixel location along a first axis of the matrix, y is a coordinate of the pixel location along a second axis which is orthogonal to the first axis, i is an integer designating one of the charge collection electrodes, $n_i$ is a number of photoelectrons collected by the ith charge collection electrode in the matrix, $x_i$ is the coordinate of the ith charge collection electrode in the matrix, M is the number of charge collection electrodes in the matrix, $N_m$ is the sum of the photoelectrons collected: by the matrix, and $y_i$ is the coordinate of the ith charge collection electrode in the matrix.

In another aspect of the present invention the signal processor determines an intensity value for the X-ray photon event in response to the electrical signals from the charge collection electrodes in the matrix.

DETAILED DESCRIPTION OF THE INVENTION

Figure 1:
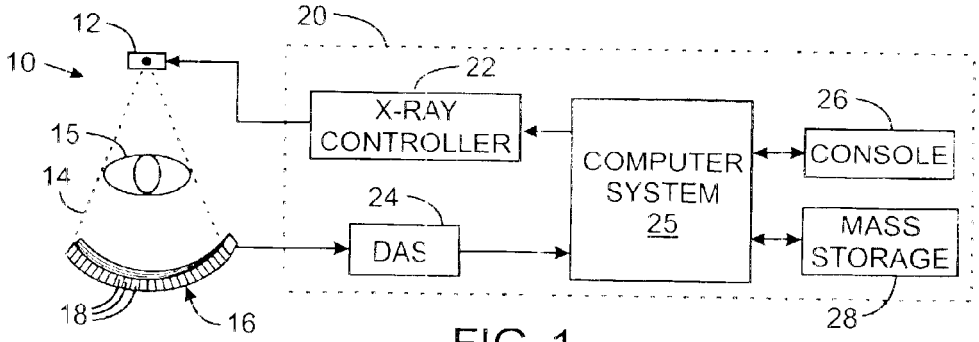
FIG. 1 is a block schematic diagram of an X-ray imaging system incorporating the present invention.

With initial reference to FIG. 1, an X-ray imaging system 10, such as used for medical imaging, has an X-ray source 12 that projects a cone beam of X-rays 14 toward a detector array 16 on the opposite side of the medical patient being imaged. The detector array 16 is formed by two dimensional array of a plurality of detector elements 18 which together sense the projected X-rays that pass through a patient 15. The impact of an X-ray photon on the detector array 16 is known as a photon event and produces electrical signals from several of the detector elements 18 as will be described. The detector array 16 has circuits which digitize the detector element signals.

Operation of the X-ray source 12 is governed by a control and image processing system 20 which includes an X-ray controller 22 that provides power and timing signals to the X-ray source 12. A data acquisition system (DAS) 24 samples data produced by detector elements 18. Operation of the X-ray controller 22 and the data acquisition system 24 are governed by a computer system 25 which receives commands and exposure parameters from an operator via a console 26 that has a keyboard and a display monitor which allows the operator to observe the X-ray image and operational data for the control and image processing system 20. The computer system 25 processes the data from the detector array 16 to determine the location of each photon event and count the photon events at each defined location on the array. That information is stored the X-ray image data in a mass storage device 28 for subsequent use in constructing an X-ray image.

Figure 2:
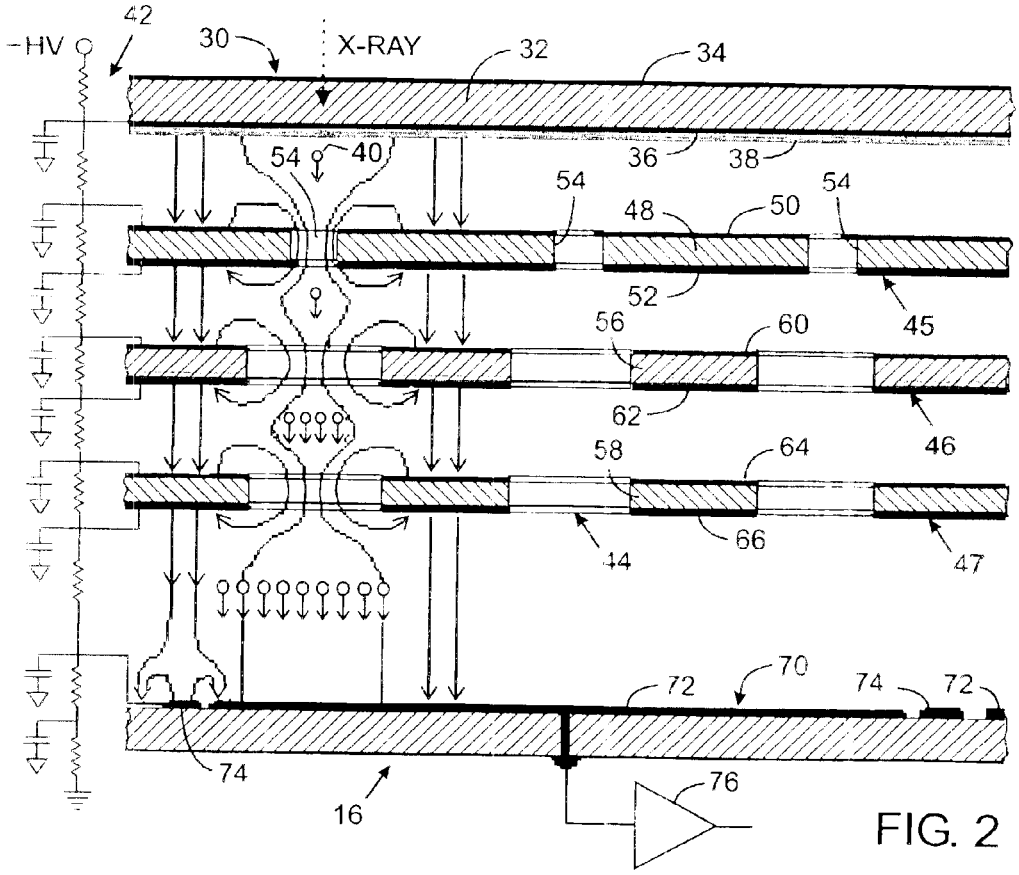
FIG. 2 is a schematic cross sectional diagram of the X-ray detector in FIG. 1.

With reference to FIG. 2, the detector array 16 and associated signal processing circuits count the number of X-ray photons impacting the detector and the location of each impact which information is used to form the X-ray image. The detector array 16 includes a scintillator 30 which has a layer of scintillation material 32, such as sodium iodide or cesium iodide. A surface of the scintillator 30 which faces the source of X-rays is coated with a film 34 that reflects light produced within the scintillator material 32 so that the light travels toward the opposite surface. That opposite surface is coated with a conductive film 36 which in turn is coated with a photocathode film 38. The conductive film 36 is connected to a voltage divider 42 which applies a relatively negative high voltage (e.g. −2800 volts) to the conductive film. The conductive film 36 is relatively thin and is highly transmissive to light at the wavelengths generated in the scintillation material 32. The desired light spread within the scintillator 30 is controlled by varying its thickness or utilizing columnar or pixellation structures, as have been used in previous detectors. The light intensity at the photocathode film 38 due to a single X-ray photon impinging the scintillation material 32 has a spatial distribution which can be measured. In the following description, a Gaussian point spread function is assumed. The photocathode film 38 emits photoelectrons 40 Upon the impingement of light from the scintillator material 32.

The photoelectrons 40 emitted by the scintillator 30 enter a gas electron multiplier (GEM) 44 having three stages 45, 46 and 47. The details and functionality of a gas electron multiplier 44 are well known, such as described in the aforementioned U.S. patent. Each GEM stage 45–47 has an electrical insulator layer with major surfaces clad with metal and have an array of electric field condensing areas formed by a plurality of through holes 54 extending through the multiplier stage. Specifically, the first GEM stage 45 has an electrical insulator material 48 sandwiched between metal layers 50 and 52. Each of the metal cladding layers 50 and 52 is connected to different points on the voltage divider 42 so that a potential difference exists across the multiplier stage thereby creating an electric field condensing area as shown by the electric field lines in the left section of the drawing, Similar electric fields are created at each hole in the multiplier stages. The metal cladding layers of each GEM stage 45–47 have progressively less negative voltage applied to them going away from the scintillator 30. The first GEM stage 45, has relatively small holes 54 as compared to the holes in subsequent stages and also has a unity or small gain which is chosen to minimize gas scintillated photon and ion feedback to the photocathode 38. In other words, the first GEM stage 45 serves as an electron extraction and feedback blocking function.

The second and third GEM stages 46 and 47 have a similar physical construction to the first GEM stage 45. In particular an insulator layer 56 of the second GEM stage 46 is clad with metal layers 60 and 62, and the third GEM stage 47 is clad with metal layers 64 and 66. Each of these metal cladding layers 60–64 is connected to successive taps of the voltage divider 42 to create an increasingly less negative bias on those conductive layers. The signal gain desired for the GEM 44 is provided by the second and third stages 46 and 47, each providing a gain between 10 and 100. Because high GEM gains have an adverse impact on the stability and counting rate capability, it is preferred that these gains be kept relatively moderate. As is well known, the gains are determined based on the required X-ray counting rate (with lower gains required for higher rates), the read-out electronic noise level, and the photoelectron production from the scintillator 30 (with lower photoelectron production requiring higher gain). Additional GEM stages can be inserted if greater gain is required.

The photoelectrons flowing from the third GEM stage 47 travel toward a read-out stage 70 which comprises a two dimensional array of charge collection electrodes 72 separated in both dimensions by a focusing grid 74. The focusing grid 74 is connected to a final tap of the voltage divider 42 thereby being biased to attract the photoelectrons from the third GEM stage 47. Each charge collection electrode 72 receives incoming photoelectrons from the gas electron multiplier 44 and is connected via a preamplifier 76 to the digital acquisition system 24 in FIG. 1. When the pulse from an individual preamplifier exceeds a predetermined level, the pulse signal is digitized by an analog to digital converter (ADC) 77 with at adequate resolution (e.g. three-bits). Then the DAS 24 defines a matrix of 3×3 (or 5×5) charge collection electrodes 72 having the greatest signal values.

Figure 3:
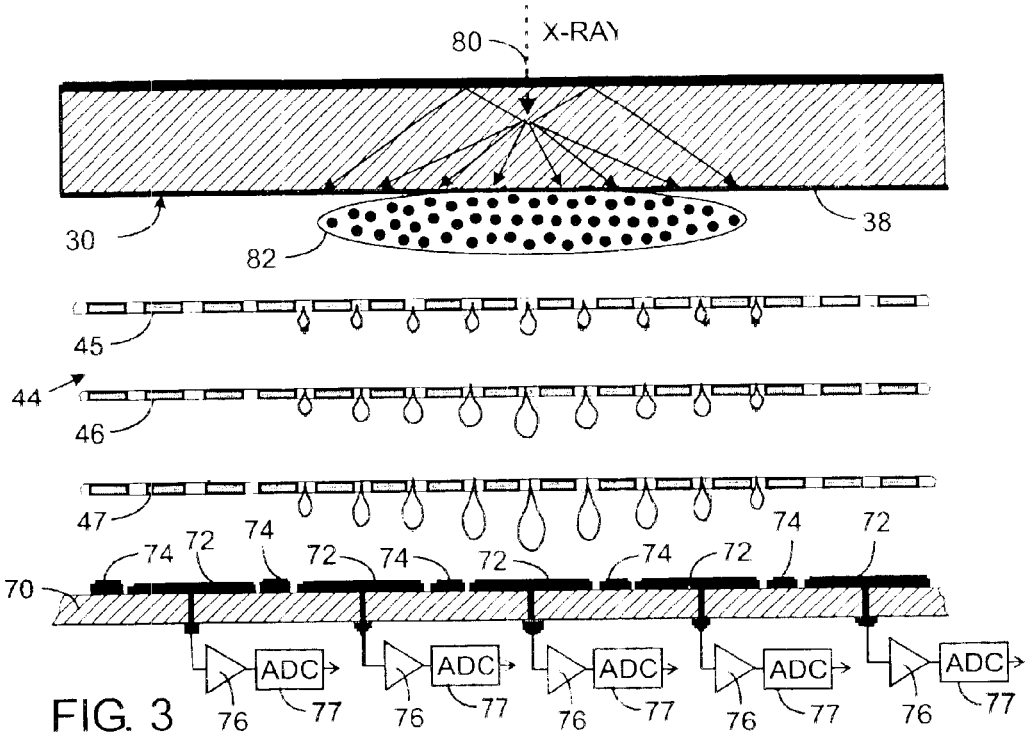
FIG. 3 illustrates signal formation in the X-ray detector.

The readout circuitry and the digital acquisition system 24 operate with sufficient speed so as to sense photoelectrons impinging the collection electrodes 72 resulting from a single X-ray photon striking the scintillator 30. In other words, when the signal from a given charge collection electrode 42 is read out, that signal level corresponds to a single X-ray photon event. Furthermore, reference to FIG. 2 also shows that there are several channels through the GEM 42 for each charge collection electrode 72. It should be understood that an X-ray photon event occurring at one point in the scintillator 30, results in photoelectrons from the photocathode 38 entering several of these channels. In fact, as shown in FIG. 3, an X-ray photon 80 striking the scintillator 30 produces light photons which strike an area of the photocathode 38 thereby producing a cloud of primary photoelectrons 82. The scintillator light point spread function at the photocathode 38, as well as the photoelectron distribution in the cloud 82, has a Gaussian distribution in two dimensions about the path the X-ray photon 80. The photoelectrons in the cloud 82 enter the GEMs 44 and are multiplied as they travel toward the charge collection electrodes 72. A single X-ray photon event produces a flow of photoelectrons through the GEMs 42 which impact a plurality of the charge collection electrodes 72 in a two dimension region of the read-out stage 70.

The processing of data from the X-ray detector 16 utilizes signal samples from a square matrix of charge collection electrodes 72 to determine the intensity and location of each X-ray photon striking the detector. The intensity and location determination is based on the signal samples from a square matrix of charge collection electrodes 72 that is defined by the computer system 25 for each X-ray photon event. The processing will be described in the context of a three by three matrix with the understanding that a five by five or larger square matrix may be employed.

Figure 4:
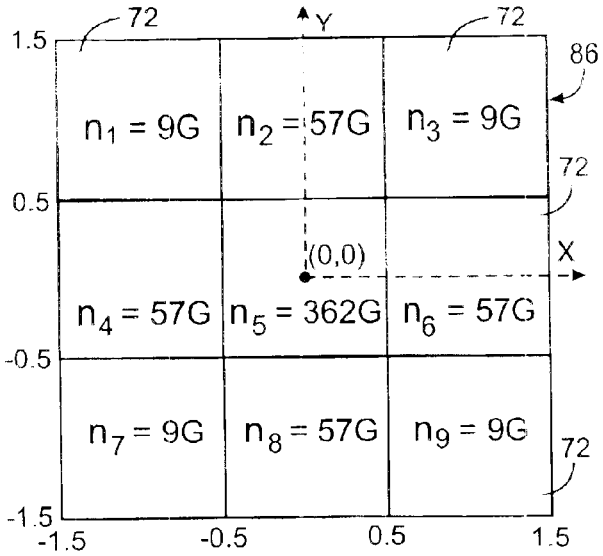
FIG. 4 depicts the two dimensional distribution of photoelectrons on a three by three electrode matrix defined in the X-ray detector.

FIG. 4 depicts the two dimensional distribution of the photoelectrons striking a three by three matrix 86 of charge collection electrodes 72 as a result of an X-ray photon event occurring directly above the midpoint of the central electrode in that matrix. Assuming that 624 photoelectrons were emitted by the photocathode 38 as a result of that single X-ray photon impact, the distribution of photoelectrons striking the nine charge collection electrodes 72 in the matrix 86 is indicated by the numbers $n_i$ within each matrix square where n is the number of primary photoelectrons, i designates the particular charge collection electrode, and G is the total gain of the GEMs 44. Thus, the number of photoelectrons striking each charge collection electrode 72 has a substantially Gaussian distribution about the center of the matrix 86, which in this case corresponds to the location of the X-ray photon event that occurred in the scintillator 30 directly above the matrix center. A precise Gaussian distribution is the ideal case and the actual number of photoelectrons striking each charge collection electrode differs from the ideal due to noise and other factors. Nevertheless, a substantially Gaussian distribution occurs. The impact of photoelectrons causes a charge to accumulate on the affected charge collection electrodes 72.

The DAS 24 continuously receives signals from plurality of preamplifiers 76 and ADC's 77 and stores digital signal samples denoting the magnitude of charge on each charge collection electrode 72. Upon receiving the signal samples from the DAS 24, the computer system 25 selects the charge collection electrode 72 which produced the largest signal sample as being the central electrode of the processing matrix 86. The remainder of that three by three matrix 86 is formed by the eight charge collection electrodes 72 that surround the selected central electrode. The coordinates ($x_i$, $y_i$) of each charge collection electrode in the defined matrix 86 is designated based on an origin at the midpoint of the central electrode, as depicted in FIG. 4. Furthermore, by knowing the gain of the GEMs the number of primary photoelectrons for each charge collection electrode 72 can be derived from the total signal produced by that electrode.

Figure 5:
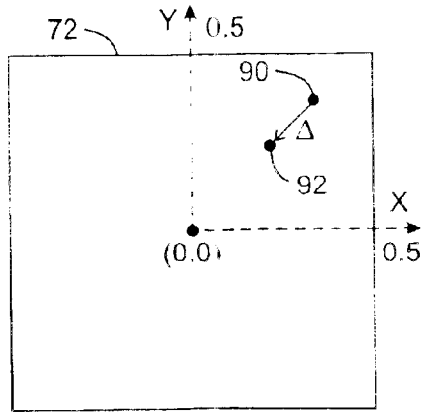
FIG. 5 illustrates a sub-pixel displacement detection error for an X-ray event occurring off-center in the electrode matrix.

The example depicted in FIG. 4 assumes that the X-ray photon event occurred directly above the midpoint of the central charge collection electrode in the designated matrix 86. However, it is more likely that the X-ray photon event will be offset from the midpoint of a charge collection electrode 72. As seen in FIG. 5, the X-ray photon event is likely to occur above some location 90 that is offset from the center (0,0) of a charge collection electrode 72. As a result, the peak of the Gaussian distribution of photoelectrons impacting the charge collection electrodes is shifted to coincide with that location 90.

Heretofore, the image processing identified the X-ray photon event as being located at the position of the charge collection electrode 72 that produced the largest signal. Thus the resolution of the X-ray detector was equal to the pitch of the charge collection electrodes. The computer system 25 in the present imaging system 10 is able to determine the location of the X-ray photon with finer resolution by determining that location within the area of the central electrode in the defined square matrix 86. That determination is based on the signal samples produced by the charge collection electrode 72 in that matrix.

The x and y coordinates of the X-ray photon event with respect to the midpoint (0,0) of the matrix 86 are derived by the computer system 25 by determining an intensity weighted mean of electron distribution along two orthogonal axes according to equations 1 and 2:

$$x = \frac{\sum_i^m n_i x_i}{\sum_i^m n_i} = \frac{\sum_i^m n_i x_i}{N_m} \tag{1}$$

$$y = \frac{\sum_i^m n_i y_i}{\sum_i^m n_i} = \frac{\sum_i^m n_i y_i}{N_m} \tag{2}$$

where X is a coordinate of the X-ray photon event location along a first axis of the matrix, y is a coordinate of the X-ray photon event location along a second axis which is orthogonal to the first axis, i is an integer designating one of the charge collection electrodes, $n_i$ is a number of primary photoelectrons collected by the ith charge collection electrode in the matrix, $x_i$ is the coordinate of the ith charge collection electrode in the matrix, m is the number of charge collection electrodes in the matrix, $N_m$ is the sum of the primary photoelectrons collected by the matrix, and $y_i$ is the coordinate of the ith charge collection electrode in the matrix.

The coordinates x, y of the X-ray photon event and photon intensity as denoted by M are stored in the memory of the computer system 25 for subsequent use with similar data from the other X-ray photon events occurring in a given X-ray exposure to construct an image of the object 15. Thus This analysis of the electrical signals from the charge collection electrodes in the matrix determines the location of the X-ray photon event even where the resultant light has spread in the scintillator and produced a sizable cloud of electrons. Therefore, the adverse effect on image resolution that results from light spread in the scintillator is reduced by locating the X-ray photon event according to the present technique. This allows a thicker scintillator to be employed for increased X-ray detection efficiency without a significant decrease in image resolution.

It should be understood that some of the photoelectrons at the periphery of the cloud 82 may strike the read-out stage 70 outside the square matrix 86. This effect is of little concern when the X-ray photon event occurs directly over the center of a charge collection electrode 72, as those outer photoelectrons are evenly distributed in all directions around the matrix. However, the X-ray photon event probably is offset from the center of a charge collection electrode 72, such as above location 90 in FIG. 5. Therefore, some of the primary photoelectrons in the upper right portion of the cloud 82 will not fall within the three by three electrode matrix 85. As a consequence, derivation of the X-ray photon event location will be based on non-symmetrical data samples and can produce coordinates for a point 92 which is displaced from the actual-X-ray event location 90. Noise which effects the system also contributes to the displacement Δ. Both quantum noise, due to variation in the number of photoelectrons produced at different sections of the scintillator 30 according to a Poisson distribution, and spatial quantization noise contribute to the displacement of the calculated location from the actual location of the X-ray photon event.

The displacement error can be corrected by collecting empirical data which quantifies that error. One technique sends X-rays through a fine pin hole to impinge a well-defined known location on the read-out stage 70. The signals from the charge collection electrodes 72 are processed, as described previously, to calculate the location of the X-ray photon event. The calculated location, (X,Y)_cal, is compared to the actual location, (X,Y)_true, to determine a correction coefficient, (X,Y)_coef=(X,Y)_true−(X,Y)_cal. The correction coefficient for each central charge collection electrode can be derived in this manner and stored in a look-up table. During the real imaging, each calculated location is corrected to produce a corrected location, (X,Y)_corr=(X,Y)_cal+(X,Y)_coef.

Another calibration technique employs a very large matrix size (e.g. a nine by nine matrix instead of a three by three matrix used during imaging). Very few photoelectrons are undetected with that much larger matrix, and equations (1) and (2) yield substantially the actual location, (X,Y)_true, of the X-ray photon event. Although this much larger matrix could be employed during real imaging, significantly greater signal processing time would be required, for example the processing time is nine times greater for a nine by nine matrix then for a three by three matrix. During this latter calibration technique, the photon event location is calculated twice, once using data from the entire nine by nine matrix and again with the data from only a three by three matrix. The difference in the two calculated locations defines the displacement error for the center charge collection electrode of the matrices and thus the correction coefficient.

The foregoing description was primarily directed to a preferred embodiment of the invention. Although some attention was given to various alternatives within the scope of the invention, it is anticipated that one skilled in the art will likely realize additional alternatives that are now apparent from disclosure of embodiments of the invention. Accordingly, the scope of the invention should be determined from the following claims and not limited by the above disclosure.

What is claimed is:

1. An apparatus for detecting X-rays comprising:

a scintillator which produces light upon being impacted by an X-ray photon, which is referred to as an X-ray photon event;

a photocathode adjacent the scintillator and which emits a plurality of photoelectrons in response to light from the scintillator;

a gas electron multiplier adjacent the scintillator to receive the plurality of photoelectrons and having a plurality of stages;

a two dimensional array of charge collection electrodes positioned to receive photoelectrons emitted by the gas electron multiplier in response to receipt of the plurality of photoelectrons from the scintillator, wherein each charge collection electrode produces an electrical signal indicating a quantity of photoelectrons which have struck that respective charge collection electrode; and a signal processor which analyzes the electrical signals from a two dimensional matrix of a plurality of the charge collection electrodes in the two dimensional array to determine a location of the X-ray photon event.

2. The apparatus as recited in claim 1 wherein the signal processor determines an intensity value for the X-ray photon event in response to the electrical signals from the charge collection electrodes in the matrix.

3. The apparatus as recited in claim 1 wherein the signal processor sums the electrical signals from the charge collection electrodes in the matrix to produce an energy value for the X-ray photon event.

4. The apparatus as recited in claim 1 wherein the signal processor determines the location of the X-ray photon event by deriving an intensity weighted mean of the electrical signals from the two dimensional matrix of a plurality of the charge collection electrodes.

5. The apparatus as recited in claim 1 wherein the signal processor determines the location of the X-ray photon event according to the equations:

$$x = \frac{\sum_{i}^{m} n_i x_i}{\sum_{i}^{m} n_i} = \frac{\sum_{i}^{m} n_i x_i}{N_m}$$

$$y = \frac{\sum_{i}^{m} n_i y_i}{\sum_{i}^{m} n_i} = \frac{\sum_{i}^{m} n_i y_i}{N_m}$$

where X is a coordinate of the pixel location along a first axis of the matrix, y is a coordinate of the pixel location along a second axis which is orthogonal to the first axis, i is an integer designating one of the charge collection electrodes, $n_I$ is a number of primary photoelectrons collected by the ith charge collection electrode in the matrix, $x_i$ is the coordinate of the ith charge collection electrode in the matrix, M is the number of charge collection electrodes in the matrix, $N_m$ is the sum of the primary photoelectrons collected by the matrix, and $y_i$ is the coordinate of the ith charge collection electrode in the matrix.

6. The apparatus as recited in claim 1 wherein each stage of the gas electron multiplier comprises:

an insulator having first and second foil metal claddings on opposed faces thereof forming a sandwich structure; and a plurality of through holes traversing said sandwich structure.

7. The apparatus as recited in claim 6 further comprising a source of first and second bias voltage potentials which are applied to the first and second metal claddings respectively so as to generate an electric field condensing area at each of the through holes.

8. The apparatus as recited in claim 1 further comprising a focusing grid between adjacent ones of the charge collection electrodes.

9. An apparatus for detecting X-rays comprising:

a scintillator which produces light upon being impacted by an X-ray photon, which is referred to as an X-ray photon event;

a photocathode adjacent the scintillator and which emits a plurality of photoelectrons in response to light from the scintillator;

a gas electron multiplier adjacent the scintillator to receive the plurality of photoelectrons, the gas electron multiplier having a first stage, a second stage and a third stage wherein the first stage has substantially unity gain to minimize gas scintillated photon and ion feedback to the scintillator and the second and third stages each has a gain between 10 and 100;

a two dimensional array of charge collection electrodes positioned to receive photoelectrons emitted by the gas electron multiplier in response to receipt of the plurality of photoelectrons from the scintillator, wherein each charge collection electrode produces an electrical signal indicating a quantity of photoelectrons which have struck that respective charge collection electrode; and a signal processor which determines a location of the X-ray photon event by deriving an intensity weighted mean of the electrical signals from a square matrix of charge collection electrodes.

10. The apparatus as recited in claim 9 wherein each of the first, second and third stages of the gas electron multiplier comprises:

an insulator having first and second metal claddings on opposed faces thereof forming a sandwich structure; and a plurality of through holes traversing said sandwich structure.

11. The apparatus as recited in claim 10 further comprising a source of a plurality of bias voltage potentials which are applied to the first and second metal claddings of the first, second and third stages so as to generate an electric field condensing area at each of the through holes.

12. The apparatus as recited in claim 9 wherein the signal processor determines an intensity value for the X-ray photon event in response to the electrical signals from the charge collection electrodes in the matrix.

13. A method for detecting X-rays comprising:

providing a scintillator which produces light upon being impacted by an X-ray photon, which impact is referred to as an X-ray photon event;

providing a photocathode which emits a plurality of photoelectrons in response to light from the scintillator;

amplifying the photoelectrons in a gas electron multiplier having a plurality of stages;

receiving, at a two dimensional array of charge collection electrodes, photoelectrons emitted from the gas electron multiplier, wherein each charge collection electrode produces an electrical signal indicating a quantity of photoelectrons which strike respective charge collection electrode; and determining a location of the X-ray photon event in response to the electrical signals from a two dimensional matrix of a plurality of the charge collection electrodes in the two dimensional array.

14. The method as recited in claim 13 wherein determining a location of the X-ray photon event comprises deriving an intensity weighted mean of the electrical signals from the two dimensional matrix of a plurality of the charge collection electrodes.

15. The method as recited in claim 13 wherein determining a location of the X-ray photon event employs the equations:

$$x = \frac{\sum_{i}^{m} n_i x_i}{\sum_{i}^{m} n_i} = \frac{\sum_{i}^{m} n_i x_i}{N_m}$$

$$y = \frac{\sum_{i}^{m} n_i y_i}{\sum_{i}^{m} n_i} = \frac{\sum_{i}^{m} n_i y_i}{N_m}$$

where X is a coordinate of the pixel location along a first axis of the matrix, y is a coordinate of the pixel location along a second axis which is orthogonal to the first axis, i is an integer designating one of the charge collection electrodes, $n_I$ is a number of primary photoelectrons collected by the ith charge collection electrode in the matrix, $x_i$ is the coordinate of the ith charge collection electrode in the matrix, M is the number of charge collection electrodes in the matrix, $N_m$ is the sum of the primary photoelectrons collected by the matrix, and $y_i$ is the coordinate of the ith charge collection electrode in the matrix.

16. The method as recited in claim 13 further comprising determining an intensity value for the X-ray photon event in response to the electrical signals from the charge collection electrodes in the matrix.

17. The method as recited in claim 13 further comprising correcting the location of the X-ray photon event with a displacement error correction coefficient to produce a corrected location of the X-ray photon event.

* * * * *